US011241879B2

(12) United States Patent
Korthuis et al.

(10) Patent No.: US 11,241,879 B2
(45) Date of Patent: Feb. 8, 2022

(54) FLUID PUMP ACTUATION ON A FLUID EJECTION DEVICE

(71) Applicant: HEWLETT-PACKARD DEVELOPMENT COMPANY, L.P., Spring, TX (US)

(72) Inventors: Vincent C Korthuis, Corvallis, OR (US); Eric T Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 303 days.

(21) Appl. No.: 16/339,054

(22) PCT Filed: Jan. 19, 2017

(86) PCT No.: PCT/US2017/014144

§ 371 (c)(1),
(2) Date: Apr. 3, 2019

(87) PCT Pub. No.: WO2018/136073

PCT Pub. Date: Jul. 26, 2018

(65) Prior Publication Data

US 2021/0283909 A1 Sep. 16, 2021

(51) Int. Cl.
*B41J 2/045* (2006.01)
*B41J 2/175* (2006.01)

(52) U.S. Cl.
CPC ..... *B41J 2/04501* (2013.01); *B41J 2/17596* (2013.01); *B41J 2/0458* (2013.01); *B41J 2/04581* (2013.01)

(58) Field of Classification Search
CPC ..... B41J 2/04501; B41J 2/17596; B41J 2/04581; B41J 2/0458
See application file for complete search history.

(56) References Cited

U.S. PATENT DOCUMENTS

| | | | |
|---|---|---|---|
| 6,886,924 | B2 | 5/2005 | Hasenbein et al. |
| 7,467,840 | B2 | 12/2008 | Dijksman et al. |
| 8,814,293 | B2 | 8/2014 | Struck et al. |
| 10,220,609 | B2 | 3/2019 | Anderson et al. |

(Continued)

FOREIGN PATENT DOCUMENTS

| | | |
|---|---|---|
| EP | 2371545 | 10/2011 |
| JP | 2013213422 A | 10/2013 |

(Continued)

OTHER PUBLICATIONS

Govyadinov, A.N. et al., Single-pulse Dynamics and Flow Rates of Inertial Micropumps, Apr. 18, 2016, < https://arxiv.org/pdf/1509.03004.pdf>.

*Primary Examiner* — Justin Seo
(74) *Attorney, Agent, or Firm* — Dierker & Kavanaugh PC

(57) ABSTRACT

A fluid ejection device may include fluid ejectors, fluid pumps to circulate fluid to the fluid ejectors, a first actuation signal line and at least one second actuation signal line. The first actuation signal line is connected to each of the fluid ejectors and each of the fluid pumps along which a first signal is transmittable to actuate a selected one of fluid ejectors and the fluid pumps. The at least one second actuation signal line is connected to the fluid pumps along which a second signal is transmittable to actuate a selected one of the fluid pumps.

15 Claims, 7 Drawing Sheets

(56) References Cited

U.S. PATENT DOCUMENTS

| | | | | |
|---|---|---|---|---|
| 2002/0140772 | A1 | 10/2002 | Torgerson et al. | |
| 2012/0229565 | A1 | 9/2012 | Yuda et al. | |
| 2015/0282830 | A1 | 8/2015 | Miyazaki et al. | |
| 2015/0290943 | A1 | 10/2015 | Masaki et al. | |
| 2016/0311221 | A1 | 10/2016 | Menzel | |
| 2017/0146005 | A1* | 5/2017 | Edelen | A24F 40/50 |
| 2018/0147841 | A1* | 5/2018 | Clark | B41J 2/0458 |

FOREIGN PATENT DOCUMENTS

| | | |
|---|---|---|
| WO | WO-2009049349 | 4/2009 |
| WO | WO-2016024973 | 2/2016 |
| WO | WO-2016068989 | 5/2016 |

* cited by examiner

MODE = 0 NORMAL OPERATION
MODE = 1 PUMP ADDR = TIJ + OFFSET
MODE = 2 PUMP ADDR = EMBEDDED

1000

POSEIDON FIRE PULSE GROUP
DATA 0
SLOTS A & B

| MCLK CYCLE# | DATA 0 RISE | | DATA 0 FALL | |
|---|---|---|---|---|
| 1 | START ("1") | | MODE[1] | |
| 2 | START ("0") | | MODE[0] | |
| 3 | START ("1") | | | |
| 4 | | | | |
| 5 | ADDR L[3] | | | |
| 6 | ADDR L[2] | | | |
| 7 | ADDR L[1] | | | |
| 8 | ADDR L[0] | | | |
| 9 | A | 2 | A | 1 |
| 10 | B | 2 | B | 1 |
| 11 | A | 4 | A | 3 |
| 12 | B | 4 | B | 3 |
| 13 | A | 6 | A | 5 |
| 14 | B | 6 | B | 5 |

1002

POSEIDON FIRE PULSE GROUP
DATA 1
SLOTS C & D

| MCLK CYCLE# | DATA 1 RISE | | DATA 1 FALL | |
|---|---|---|---|---|
| 1 | X | | | |
| 2 | X | | | |
| 3 | X | | | |
| 4 | | | | |
| 5 | | | | |
| 6 | | | | |
| 7 | | | | |
| 8 | | | | |
| 9 | C | 2 | C | 1 |
| 10 | D | 2 | D | 1 |
| 11 | C | 4 | C | 3 |
| 12 | D | 4 | D | 3 |
| 13 | C | 6 | C | 5 |
| 14 | D | 6 | D | 5 |

1004

1006

16 ADDRESSES (4BIT)
TIJ EVEN ADDRESS
PUMP ODD ADDRESS
1:1 FIRE ORDER
SKIP 2 PATTERN:
0,6,12,2,8,14,4,10
ON DIE OFFSET = 13
PUMP FIRE ORDER = TIJ +13
13,3,9,15,5,11,1,7

FIG. 15

MODE = 0 NORMAL OPERATION
MODE = 1 PUMP ADDR = TIJ + OFFSET
MODE = 2 PUMP ADDR = EMBEDDED

1100

POSEIDON FIRE PULSE GROUP
DATA 0
SLOTS A & B

| MCLK CYCLE# | DATA 0 RISE | | DATA 0 FALL | |
|---|---|---|---|---|
| 1 | START ("1") | | MODE[1] | |
| 2 | START ("0") | | MODE[0] | |
| 3 | START ("1") | | | |
| 4 | | | | |
| 5 | ADDR L[3] | | PUMP ADDR L[3] | |
| 6 | ADDR L[2] | | PUMP ADDR L[2] | |
| 7 | ADDR L[1] | | PUMP ADDR L[1] | |
| 8 | ADDR L[0] | | PUMP ADDR L[0] | |
| 9 | A | 2 | A | 1 |
| 10 | B | 2 | B | 1 |
| 11 | A | 4 | A | 3 |
| 12 | B | 4 | B | 3 |
| 13 | A | 6 | A | 5 |
| 14 | B | 6 | B | 5 |

1004

1006

1102

POSEIDON FIRE PULSE GROUP
DATA 1
SLOTS C & D

| MCLK CYCLE# | DATA 1 RISE | | DATA 1 FALL | |
|---|---|---|---|---|
| 1 | X | | | |
| 2 | X | | | |
| 3 | X | | | |
| 4 | | | | |
| 5 | | | | |
| 6 | | | | |
| 7 | | | | |
| 8 | | | | |
| 9 | C | 2 | C | 1 |
| 10 | D | 2 | D | 1 |
| 11 | C | 4 | C | 3 |
| 12 | D | 4 | D | 3 |
| 13 | C | 6 | C | 5 |
| 14 | D | 6 | D | 5 |

SYSTEM LOOKUP TABLE 1130

| 2:1 RECIRC: FIRE ORDER= 0,3,6,1,4,7,2,5 | | |
|---|---|---|
| TIJ ADDR | TIJ ADDR | SAFE PUMP ADDR |
| 0 | 3 | 10 |
| 6 | 1 | 9 |
| 4 | 7 | 8 |
| 2 | 5 | 11 |

2:1 FIRE ORDER
SKIP 2 PATTERN:
0,3,6,1,4,7,2,5

FIG. 16

FLUID PUMP ACTUATION ON A FLUID EJECTION DEVICE

BACKGROUND

Fluid ejection devices may include fluid ejectors that selectively eject droplets of fluid. The fluid ejection devices sometimes additionally include fluid pumps that mix and maintain fresh fluid in the ejection chambers of such fluid ejectors.

BRIEF DESCRIPTION OF THE DRAWINGS

FIG. 15 is a diagram illustrating an example pair of transmittable data packets for controlling actuation of fluid ejectors and fluid pumps on a fluid ejection device.

FIG. 16 is a diagram illustrating another example pair of transmittable data packets for controlling actuation of fluid ejectors and fluid pumps on a fluid ejection device.

Figure 1:
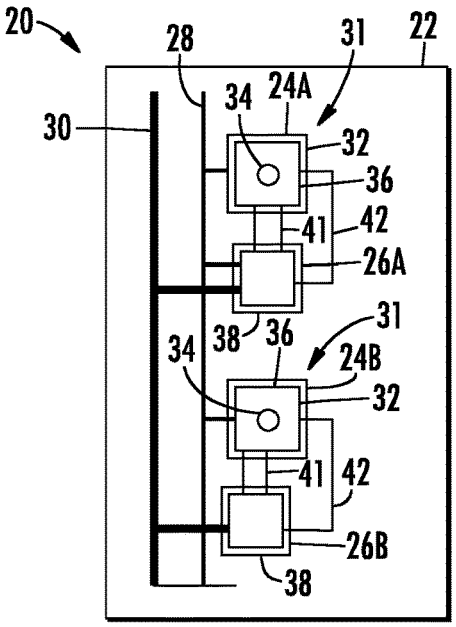
FIG. 1 is a schematic diagram of an example fluid ejection device.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION OF EXAMPLES

Fluid pumps are sometimes utilized by fluid ejection devices to circulate fluid through and across an ejection chamber of a fluid ejector. Such fluid pumps are actuated in response to signals actuating the associated fluid ejector. The circulation of the fluid through the ejection chamber not only supplies the associated fluid ejector with fresh fluid for ejection, but also mixes the fluid.

In some circumstances, such as during fluid ejection at high densities, or due to fluidic or power constraints, actuation or firing of the fluid ejectors may occur at a low frequency. As a result, the corresponding actuation of the associated fluid pumps also occurs at a low frequency. Such low-frequency fluid ejection and low-frequency pump actuation may lead to inadequate mixing of the fluid. Moreover, with thermal fluid pumps and thermal fluid ejectors, such low-frequency pump actuation may result in the fluid ejection device being unable to heat to a target temperature during fluid ejection.

Disclosed herein are various examples of a fluid ejection device, a fluid ejection system and a method that provide fluid mixing and servicing of the fluid ejectors on a fluid ejection device during low-frequency fluid ejection. Each of the various examples facilitates actuation of the fluid pumps at a frequency independent of the frequency at which the associated fluid ejectors are being actuated or fired. As a result, during periods of low frequency fluid ejection, fluid may be circulated through and across the ejection chambers of presently inactive fluid ejectors to provide high-frequency servicing of the fluid ejection device.

Disclosed is an example fluid ejection device that comprises at least one separate independent actuation signal line connected to each of the fluid pumps, facilitating actuation of the fluid pumps at a frequency independent of the frequency at which the associated fluid ejectors are fired. Disclosed is an example fluid ejection system that comprises a controller that transmits signals to a fluid ejection device, wherein the signals actuate different fluid ejectors and their associated fluid pumps at a first frequency to eject fluid at the first frequency and that also actuate selected different fluid pumps at a second frequency greater than the first frequency. Disclosed is an example method which comprises ejecting fluid at a first frequency by actuating fluid ejectors and their associated pumps at a first frequency while servicing inactive fluid ejectors at a second frequency greater than the first frequency by actuating fluid pumps associated with inactive fluid ejectors at the second frequency.

FIG. 1 schematically illustrates a portion of an example fluid ejection device 20 that provides high-frequency servicing of the fluid ejectors during periods of low frequency fluid ejection. Fluid ejection device 20 comprises substrate 22, fluid ejectors 24A, 24B (collectively referred to as fluid ejectors 24), fluid pumps 26A, 26B (collectively referred to as fluid pumps 26), actuation signal line 28 and actuation signal line 30. Although fluid ejection device 120 is illustrated as comprising a pair of ejection sets 31, each ejection set 31 comprising a fluid ejector 24 and a fluid pump 26, it should be appreciated that fluid ejection device 20 may include a multitude of spaced ejection sets 31 on substrate 22, wherein actuation signal lines 28 and 30 are in communication with each of the fluid ejectors and fluid pumps of each ejection set 31.

Substrate 22 comprises a base or foundation for fluid ejectors 24, fluid pumps 26 and lines 28, 30. In one implementation, substrate 22 may be formed from silicon. In other implementations, substrate 22 may be formed from other materials such as polymers or ceramics. In one implementation, substrate 22 may be part of a fluid ejection die upon which electronic components and circuitry are fabricated.

Fluid ejectors 24 comprise devices to selectively eject fluid supplied by a fluid source (not shown). Fluid ejectors 24 each comprise an ejection chamber 32, a nozzle 34 and a fluid driver 36. Ejection chamber 32 comprises a volume adjacent and between nozzle 34 and fluid driver 36. Nozzle 34 comprises an opening extending from chamber 32 and through which fluid is ejected from chamber 32.

Fluid driver 36 comprises an element that drives fluid within chamber 32 through nozzle 34. In one implementation, fluid driver 36 comprises a thermally resistive element that upon receiving electrical current, generates a sufficient amount of heat to vaporize some of the fluid within chamber 32, creating a bubble, wherein the expanding bubble drives or propels the remaining fluid within chamber 32 through nozzle 34. In another implementation, fluid driver 36 may comprise a flexible membrane that is moved to reduce a size of ejection chamber 32 adjacent to nozzle 34, forcing fluid out of chamber 32 through nozzle 34. For example, in one implementation, fluid driver 36 may comprise a piezo-resistive element that changes shape or size in response to being heated or in response to electrical current. In yet other implementations, fluid driver 36 may comprise other devices or elements that may be selectively controlled to expel fluid within chamber 32 through nozzle 34.

Fluid pumps 26 comprise fluid drivers that pump or circulate fluid through a fluid passage 41 into an ejection chamber 32 of an associated fluid ejector 24. In the example illustrated, a single fluid pump 26 is dedicated to an associated fluid ejector 24. In other implementations, a single fluid pump 26 may be shared amongst multiple fluid ejectors 24, wherein the single fluid ejector 24 maintains mixed or fresh fluid in the ejection chambers 32 of each of the associated fluid ejectors 24. In one implementation, a single fluid pump 26 is shared by two fluid ejectors 24, being fluidly connected to the two fluid ejectorS 24 so as to maintain mixed or fresh fluid to the ejection chambers at each of the two adjacent fluid ejectors 24.

In one implementation, each of fluid pumps comprises an inertial pump. In one implementation, fluid pumps 26 are similar to fluid drivers 36. For example, in one implementation, each fluid pump 26 comprises a thermally resistive element that upon receiving electrical current, generates a sufficient amount of heat to vaporize some of the fluid within an adjacent pumping volume 38, creating a bubble, wherein the expanding bubble drives or propels the remaining fluid within volume 38 towards fluid chamber 32 through an interconnecting fluid passage 41. In another implementation, fluid pump 26 may comprise a flexible membrane that is moved to reduce a size of pumping volume 38, forcing fluid out of volume 38 towards and into chamber 32. For example, in one implementation, fluid pump 26 may comprise a piezo-resistive element that changes shape or size in response to being heated or in response to electrical current. In yet other implementations, fluid pump 26 may comprise other devices or elements that may be selectively controlled to drive and circulate fluid into and across chamber 32.

As schematically shown by FIG. 1, in one implementation, fluid chamber 32 and pumping volume 38 are fluidly coupled to one another such that fluid pumped from chamber 38 into chamber 32 and that is not ejected through nozzle 34 may recirculate back to chamber 38 through a recirculation passage 42. For purposes of this disclosure, the term "fluidly coupled" shall mean that two or more fluid transmitting volumes are connected directly to one another or are connected to one another by intermediate volumes or spaces such that fluid may flow from one volume into the other volume.

In one implementation, the recirculation passage 42 comprises a slot that supplies fluid to chamber 38 and that receives an ejected fluid from chamber 32. In one implementation, recirculation passage 42 comprises such a slot that is fluidly coupled to different multiple fluid ejectors 24 and fluid pumps 26 on opposite sides of the slot. In yet another implementation, recirculation passage 42 may comprise a fluid feed hole or passage supplying fluid to one or a selected portion of the total number of fluid pumps on substrate 22 as well as receiving non-ejected fluid from ejection chambers 32 that are associated with the selected portion of the total number of fluid pumps.

Actuation signal line 28 comprises a communication line by which fire pulses are selectively transmitted to an addressed fluid driver 36 of a fluid ejector 24 or and addressed fluid driver forming a fluid pump 26, wherein the signals actuate the fluid pump to pump fluid into ejection chamber 32 and further actuate the fluid driver 36 of the associated fluid ejector to expel fluid from chamber 32 through nozzle 34. In one implementation, line 28 comprises an electrically conductive trace formed along substrate 22. In other implementations, line 28 may comprise other signal transmitting structures such as wires or optical lines.

In the example illustrated, line 28 is connected to multiple fluid drivers of fluid ejectors 32 and their associated fluid pumps 26, wherein selected fluid ejectors and fluid pumps connected to the individual line 28 are selectively actuated using selection logic elements. For example, in one implementation, line 28 may be connected to multiple primitives, each primitive comprising multiple fluid ejectors and associated fluid pumps, wherein a particular addressed fluid ejector and associated fluid pump of each primitive is actuated in response to a signal transmitted along the individual line 28. In some implementations, the signals transmitted along lines 28 comprise fire pulse signals that are to all of the sets 31 of pump/nozzle pairs, which are used to generate per-nozzle/pump activation signals.

Servicing actuation signal line 30 comprises a communication line by which signals may be transmitted to individual fluid pumps 26 independent of line 28 such that an individual fluid pump 26 may be selectively actuated or fired while the associated fluid ejector is not being actuated and while a different fluid ejector is being actuated in response to signals communicated along lines 28. In other words, servicing actuation signal line 30 facilitates the concurrent actuation of two different fluid drivers, one fluid driver serving as part of a fluid ejector and another fluid driver serving as a fluid pump for a presently inactive fluid ejector.

In the example illustrated, line 30 is connected to fluid pumps 26, wherein a selected fluid pump or multiple selected fluid pumps connected to the individual line 30 are selectively actuated using multiplexer electronics or logic elements on substrate 22. For example, in one implementation, line 30 may be connected to multiple primitives, each primitive comprising multiple fluid pumps, wherein a particular addressed fluid pump of each primitive is actuated at least partially in response to a signal, such as a fire pulse signal, transmitted along the individual line 30. In yet other implementations, fluid ejection device 20 may be provided with multiple individual servicing actuation signal lines 30, wherein each of the multiple lines 30 is connected to a single assigned fluid pump.

Servicing actuation signal line 30 facilitates actuation of two different fluid drivers at different frequencies. For example, while fluid ejectors and their associated fluid pumps are being actuated at a first frequency, fluid pumps associated with presently inactive fluid ejectors may also be actuated at a second frequency different than the first frequency. In one implementation, fluid pumps associated with presently inactive fluid ejectors may be actuated at a higher frequency as compared to the frequency at which the active fluid ejectors and their associated pumps are actuated. As a result, during low-frequency fluid ejection which might otherwise result in inadequate mixing of the fluid and other servicing issues, those fluid pumps associated with the presently inactive fluid ejectors may be actuated at a higher frequency to provide higher frequency servicing of such inactive fluid ejectors.

Figure 2:
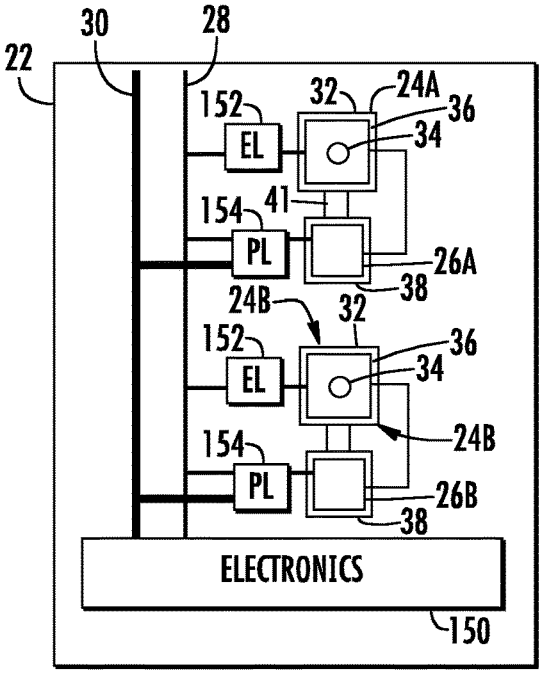
FIG. 2 is a schematic diagram of another example fluid ejection device.

FIG. 2 schematically illustrates fluid ejection device 120, another example implementation of fluid ejection device 20. Fluid ejection device 120 is similar to fluid ejection device 20 except that fluid ejection device 120 additionally comprises electronics 150, ejector logic 152 and pump logic 154. Those remaining elements of device 120 which correspond to elements of device 20 are numbered similarly.

Electronics 150 comprises electronic circuitry and/or a processing unit and associated software or programmed instructions stored on a non-transitory computer-readable medium that participate in the control of the actuation of fluid ejectors 24 and fluid pumps 26. In one implementation, electronics 150 comprise circuitry integrated into and formed upon substrate 22. In another implementation, electronic 150 comprise circuitry mounted to substrate 22. Electronics 150 carry out method 200 described with respect to FIG. 3.

Figure 3:
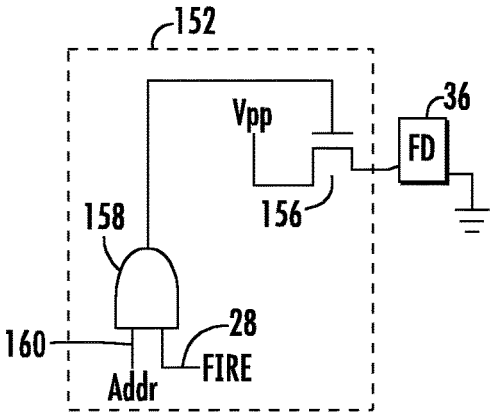
FIG. 3 is a schematic diagram of a fluid driver of a fluid ejector and associated example ejector logic for addressing and firing the fluid driver of the fluid ejector of the device of FIG. 2.

Ejector logic 152 controls the turning on and turning off of the fluid driver 36 forming the ejector 24. FIG. 3 schematically illustrates ejector logic 152 in more detail. As shown by FIG. 3, in one implementation, ejector logic 152 may comprise a transistor 156 and an AND logic circuitry or gate 158 (schematically illustrated). Transistor 156 is a switch selectively transmitting a voltage Vpp to fluid driver 36 in response to a signal received from AND logic circuitry 158. The AND logic gate 158 transmits the control signals or fire pulse signal received from line 28 to the gate of transistor 156 in response to receiving an address signal from address line 160. Address line 160 is connected to electronics 150 and receives an address signal from electronics 150 when the particular fluid driver 36 at the selected address is to be fired using a fire pulse transmittal along line 28.

Figure 4:
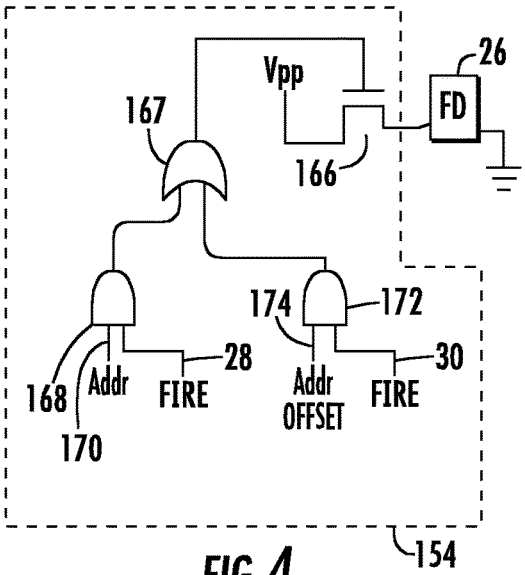
FIG. 4 is a schematic diagram of a fluid driver of a fluid pump and associated example pump logic for addressing and firing the fluid driver of the fluid pump of the device of FIG. 2.

Pump logic 152 controls the turning on and turning off of the fluid driver of a pump 26. FIG. 4 schematically illustrates pump logic 154 in more detail. As shown by FIG. 4, in one implementation, pump logic 14 may comprise a transistor 166, OR logic circuitry or gate 167, AND logic circuitry or gate 168 and AND logic circuitry or gate 172. Transistor 166 is a switch selectively transmitting a voltage Vpp to fluid driver of pump 26 in response to a signal received from OR logic gate 167. The OR logic gate 167 transmits a fire pulse signal (received from either gate 168 or gate 172) to the gate of transistor 166, turning on transistor 166 and firing fluid driver of pump 26. The AND logic gate 168 transmits the fire pulse signal being received from line 28 to the OR logic gate 167 in response to receiving an address signal from address line 170. Address line 170 is connected to electronics 150 and receives the address signal from electronics 150 when the fluid driver of the particular pump 26 at the selected address is to be fired using a fire pulse transmittal along line 28. The AND logic gate 172 transmits the fire pulse signal being transmitted along line 30 to the OR logic gate 167 in response to receiving an address signal from address line 174. Address line 174 is connected to electronics 150 and receives an address signal from electronics 150 when the fluid driver of the particular pump 26 at the selected address is to be fired using a fire pulse being transmitted along line 30.

Figure 5:
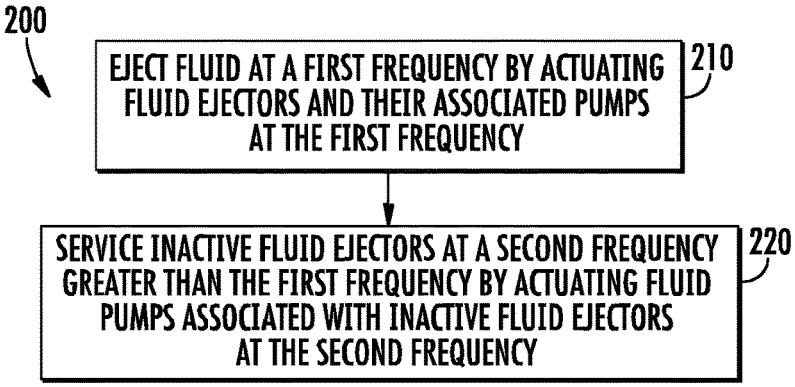
FIG. 5 is a flow diagram of an example method for controlling the actuation of fluid ejectors and fluid pumps on a fluid ejection device.

FIG. 5 illustrates an example method 200 for actuating the fluid ejectors 24 and fluid pumps 26 on a fluid ejection device, such as fluid ejection devices 20, 120. Method 200 provides enhanced servicing of fluid ejectors on an ejection device. Although method 200 is described with respect to ejection device 120, it should be understood that method 200 may be carried out on ejection device 20 or any other ejection devices such as those examples described hereafter.

As indicated by block 210, electronics 250 cause ejection device 120 to eject fluid at a first frequency by actuating fluid drivers 34 of selected fluid ejectors 24 and their associated fluid pumps 26 at a first frequency. For example, electronics 150 may output control signals that are transmitted along line 28 and that cause different ejector sets 31, fluid ejectors 24 and their associated fluid pumps 26, to be sequentially fired at the first frequency. For example, fluid ejectors 24 and pumps 26 may be actuated at the first frequency by sequentially sending in each of the ejector and pump addresses. The first frequency may be 1/(the total time consumed during a firing or actuation of all of the ejection sets 31 along line 28).

In one implementation, the multiple ejection sets 31 along line 28 may be grouped into primitives with each primitive comprising a subset of the total number of ejection sets 31 along line 28. In such an implementation, a single control signal or fire pulse is transmitted along line 28 actuating a same primitive address of each of the primitives along line 28. For example, a control signal transmitted along line 28 may result in the same addressed fluid driver (whether it be a fluid driver of a fluid ejector 24 or the fluid driver of a pump 26) of each primitive along line 28 being actuated.

As indicated by block 220, electronics 150 outputs control signals that service the inactive fluid ejectors at a second frequency greater than the first frequency by actuating fluid pumps associated with inactive fluid ejectors at the second frequency. An "inactive fluid ejector" is a fluid ejector that is not presently being fired or actuated or a fluid ejector that has not been fired for a specified amount of time. For example, fluid ejectors A, B, C, D N may be in the process of being sequentially actuated or fired at the first frequency. At one moment in time, fluid ejector A may be in the process of being fired. At such time, the remaining fluid ejectors B, C, D N are "inactive". Likewise, the fluid pumps on substrate 22 that circulate fluid to such fluid ejectors B, C, D N are also "inactive". The second frequency at which the inactive fluid ejectors are serviced may be 1/(the total time consumed during the firing of all of the fluid pumps along line 128 in response to signals transmitted along line 30 (or multiple lines 30). In one implementation, the servicing of inactive fluid ejectors does not take place during the firing of a pump 26 in response to a fire pulse transmitted along line 28.

Electronics 150 services the inactive fluid ejectors at the second frequency by outputting control signals along line 30 (or multiple lines 30) which actuate selected individual "inactive" fluid pumps. For example, at a first moment in time, electronics 150 may be outputting control signals that cause fluid to be ejected by fluid ejector 24A. During such time, fluid ejector 24B is "inactive". At the same time, electronics 150 may be outputting control signals that actuate fluid pump 26B to circulate fluid through the ejection chamber 32 of the inactive fluid ejector 24B to service the inactive fluid ejector 24B. Subsequently, at a second moment in time, electronics 150 may be outputting control signals that cause fluid to be ejected by fluid ejector 24B. During such time, fluid ejector 24A is "inactive". At the same time, electronics 150 may be outputting control signals that actuate fluid pump 26A to circulate fluid through the ejection chamber 32 of the inactive fluid ejector 24A to service the inactive fluid ejector 24A.

Figure 6:
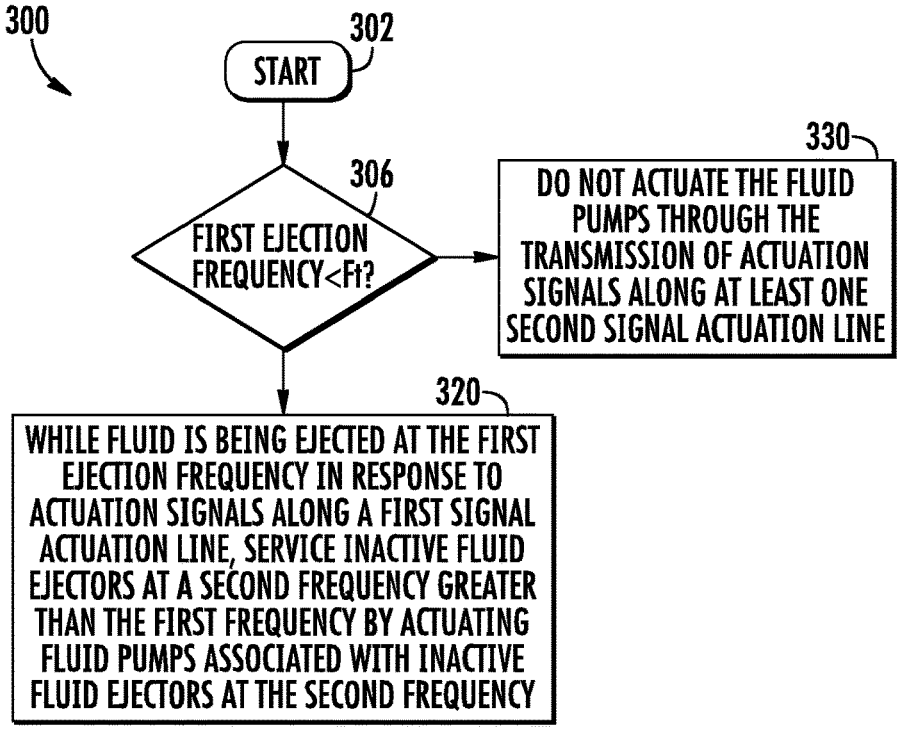
FIG. 6 is a flow diagram of another example method for controlling the actuation of fluid ejectors and fluid pumps on a fluid ejection device.

In some implementations, the servicing of "inactive" fluid ejectors may be predicated upon the frequency at which the fluid ejectors are being actuated or fired to eject fluid. In one implementation, the fluid ejection device 20, 120 may be operable in one of two modes: a first mode in which block 210 and 220 of method 200 are carried out and a second mode in which block 220 of method 200 is not carried out. FIG. 6 illustrates an example method 300 for actuating fluid ejectors and fluid pumps on a fluid ejection device. Although method 300 is described as being carried out by fluid ejection device 120, it should be appreciated that method 300 may be carried out by any of the fluid ejection devices are fluid ejection systems such as those examples described hereafter.

After startup as indicated by block 302, electronics 150 compares the first ejection frequency, the frequency at which fluid is being ejected or is to be ejected by the ejectors 24 along line 28, against a predetermined, and potentially stored, frequency threshold Ft, as indicated by block 306. In one implementation, the frequency threshold Ft is a frequency at which fluid is circulated through the different ejection chambers of fluid ejectors that is high enough such that unacceptable ejection performance is avoided. In other words, the duration of time between different consecutive time periods during which fluid is circulated across the ejection chamber of an individual fluid ejector is sufficiently small such that the fluid is less likely to congeal, settle or undergo other characteristic changes that might otherwise degrade ejection performance. In implementations where the fluid ejectors and/or thermal pumps are thermal fluid ejectors and/or thermal pumps, the frequency threshold may be a frequency such that the duration of time between different consecutive time periods during which the fluid drivers 36 and/or fluid pumps 26 are actuated is sufficiently small such that temperature characteristics that enhance fluid ejection performance are achieved or maintained.

In one implementation, the frequency threshold Ft may be a threshold of 12 KHz. In other implementations, other frequency thresholds may be utilized depending upon the frequency at which fluid should be pumped through and across ejection chambers of fluid ejectors to ovoid unacceptable ejection performance. In other implementations, other frequency thresholds may be utilized depending upon factors such as the geometry of the fluid ejection device, the type of fluid drivers 31 and/or fluid pumps 26, the operational parameters of the fluid ejection device and the characteristics of the fluid being ejected (such as the likelihood that the fluid may congeal in the absence of mixing).

As indicated by block 320, in response to the first ejection frequency being less than the frequency threshold Ft, electronics 150 continues with the ejection of the fluid at the first ejection frequency in response to the actuation signals along the first actuation signal line 28. Electronics 150 further services those fluid ejectors that are "inactive" at moments during the fluid ejection at a second frequency greater than the first frequency. Such servicing is achieved by actuating fluid pumps associated with the inactive fluid ejectors at the second frequency (as described above with respect to block 220). In one implementation, the second frequency is a frequency greater than the threshold frequency Ft. In one implementation, the second frequency is an integer multiple of the first frequency. For example, for each period of time, beginning when a fluid driver of a fluid ejector is fired in response to signals transmitted along line 28 and ending when a successive fluid driver of another fluid ejector or a pump is about to be fired in response to signals transmitted along line 28, a fluid pump associated with an inactive fluid ejector may be fired twice, three times or more in response to signals or fire pulse is transmitted along line 30. In one implementation, the second frequency is a frequency of at least 12 kHz. In one implementation, the second frequency is a frequency of at least 12 kHz and no greater than 24 kHz. In yet another implementation, the frequency is a frequency of 18 kHz.

As indicated by block 330, in response to the first ejection frequency being equal to or greater than the frequency threshold Ft, the additional or supplemental firing or actuation of those fluid pumps associated with inactive fluid ejectors is not carried out. Additional or supplemental actuation signals are not transmitted along line 30. In such a circumstance, the fluid ejectors and their associated fluid pumps may be presently being actuated at an ejection frequency that is sufficiently high such that the fluid is sufficiently mixed to reduce or avoid performance degradation. In implementations where the fluid drivers 36 and fluid pumps 26 are thermal drivers or thermal pumps, such as thermal resistive fluid ejectors or thermal resistive fluid pumps, the fluid ejectors and their associated fluid pumps may be presently being actuated at an ejection frequency that is sufficiently high such that temperature levels or characteristics are achieved that achieve acceptable fluid ejection performance of the fluid ejection device 120. At such higher ejection frequencies, excessive fluid mixing or excessive temperature levels may be avoided by not carrying out such additional or supplemental actuation of fluid pumps associated with inactive fluid ejectors.

In some implementations, selection of which of the "inactive" pumps to be actuated in response to signals transmitted along line 30 is predicated at least in part upon which fluid ejector is presently being actuated, have just been actuated or are about to be actuated in response to signals transmitted along line 28. In some implementations, the selection of the "servicing" pump to be actuated to service a presently "inactive" fluid ejector is made such that the servicing pump is a safe distance or safe number of nozzles away from the "active" fluid ejector and associated fluid pump, wherein the "active" fluid ejector comprises the fluid ejector that is presently being actuated, that have just been actuated or that are about to be actuated in response to signals transmitted along line 28. As a result, the actuation of the servicing pump to service the inactive fluid ejector is less likely to interfere with the performance or quality of the fluid ejection taking place with the active fluid ejector.

Figure 7:
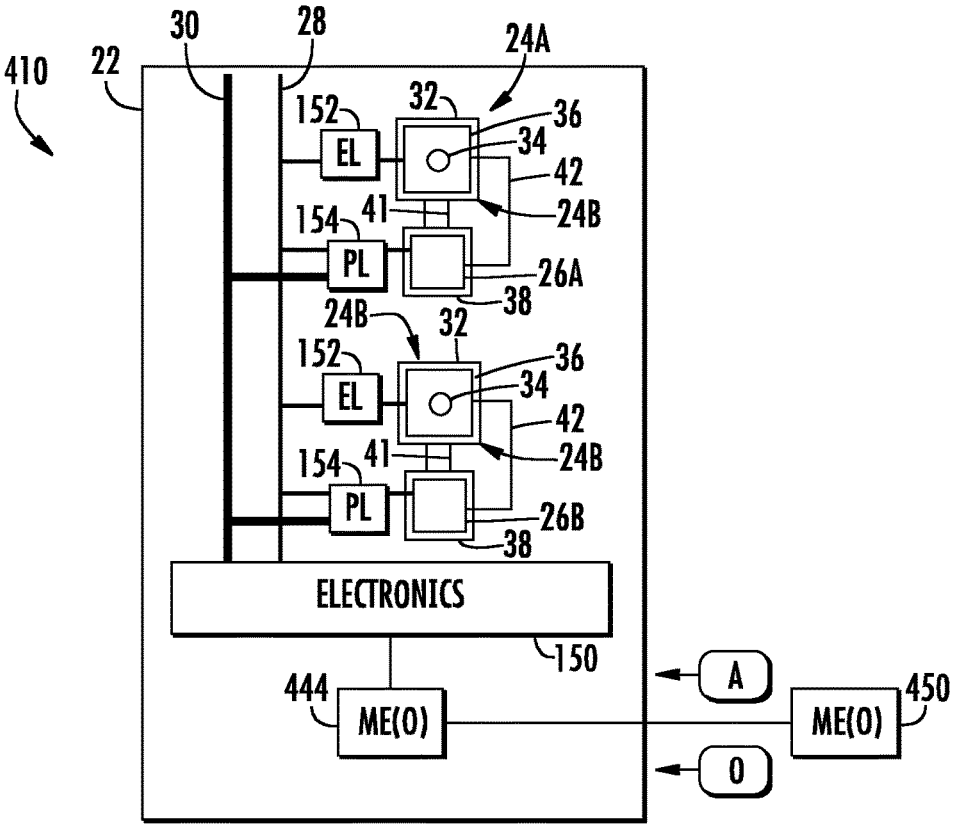
FIG. 7 is a schematic diagram of an example fluid ejection system.

FIG. 7 schematically illustrates an example fluid ejection system 410 that selects the servicing pump to be actuated to service a presently inactive fluid ejector based upon the address or location of the "active" fluid ejector in combination with a predetermined spacing or offset with respect to the address or location. Fluid ejection system 410 comprises fluid ejection device 420 and fluid ejection controller 450.

Fluid ejection device 420 is similar to fluid ejection device 120 described above except that fluid ejection device 420 is specifically illustrated as further comprising memory element 444. Memory element 444 comprises a non-transitory computer-readable medium or circuit element, such as a flip-flop or latch circuit element, that stores an offset value O directly on fluid ejection device 420 for use by electronics 150 when determining or selecting which of the fluid pumps are to be actuated using signals transmitted along line 30. In one implementation, memory element 444 comprises a nonvolatile memory by which data representing the offset value is permanently written and is not erased when system 420 is powered off. Because the offset O may be stored by memory element 444 directly on fluid ejection device 420, the offset value may be transmitted to fluid ejection device 420 and stored on memory element 444 during setup, initialization or manufacturing. As a result, transmission bandwidth is not consumed by the repeated transmission of the offset value to fluid ejection device 420.

In one implementation, fluid ejection device 420 may comprise a fluid ejection head. In one implementation, fluid ejection device 420 may be utilized as part of a printer that ejects ink onto an underlying print medium. In such an implementation, fluid ejection controller 450 may comprise a print controller. In such an implementation, fluid ejection device 420 may comprise a print head through which ink is ejected through nozzles onto a medium, such as paper. In one implementation, fluid ejection device 420 may comprise a print head that is mounted to and carried by a print cartridge that supplies ink to the fluid ejection sets on substrate 22. In another implementation, fluid ejection device 420 may comprise a print head that receives ink from an off-axis or remote fluid supply. In one implementation, fluid ejection device number 420 may have a length so as to span a width of a print medium. In yet another implementation, fluid ejection device 420 may be part of a print head that is part of a set of print heads that collectively span a width of the print medium. In another implementation, fluid ejection device 420 may be part of a print head that is scanned or transversely moved across the print medium.

Fluid ejection controller 420 is remote from electronics 150 and fluid ejection device 420. Fluid ejection controller 420 transmits image data to electronics 150 of fluid ejection device 420 (as well as other fluid ejection devices 420) in a wired or wireless fashion. In one implementation, fluid ejection controller 450 is part of a self-contained ejection system, wherein fluid ejection controller 450 and fluid ejection device 420 are part of a self-contained unit within a single housing.

As further shown by FIG. 7, in some implementations, fluid ejection controller 450 may be operable in different modes wherein fluid ejection controller 450 instructs electronics 150 as to which of the inactive fluid pumps should be actuated using control signals transmitted along line 30. In a first mode, fluid ejection controller 450 determines and transmits the offset O to electronics 150. In one implementation, the offset O may be stored in memory element 444, wherein memory element 444 comprises a nonvolatile memory. In such an implementation, the transmission of offset O by fluid ejection controller 450 may be done during initial setup of system 410 or may be done at periodic intervals. In another implementation, memory element 444 may comprise a volatile memory, such as a random access memory, wherein fluid ejection controller 450 transmits offset O at the beginning of each power up of system 410. In still other implementations, fluid ejection controller 450 may transmit offset O with each data transmission.

In a second mode of operation, rather than transmitting an offset value O to electronics 150, wherein electronics 150 utilizes the received offset O and the address of the presently active fluid ejector to determine which fluid pump associated with an inactive fluid ejector should be actuated using signals transmitted along line 30, fluid ejection controller 450 directly determines the address of the fluid pump associated with an inactive fluid ejector that should be actuated using signals transmitted along line 30 and transmits the determined address A to electronics 150. In one implementation, the determined address of the fluid pumped to be actuated using signals transmitted along line 30 may be transmitted along with the image data. In such a mode, fluid ejection controller 450 may consult a lookup table stored in a non-transitory nonvolatile memory that indicates which fluid pump or which multiple fluid pumps on the fluid ejection device 420 may be "safely" actuated when a particular fluid ejector on fluid ejection device 420 is active, when the particular fluid ejector has just been fired, or presently being fired or are about to be immediately fired.

Figure 8:
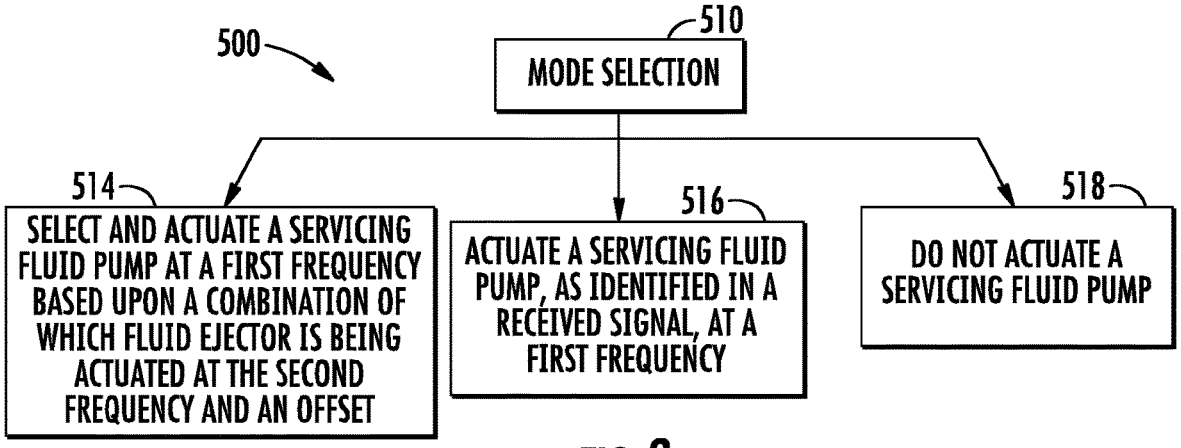
FIG. 8 is a flow diagram of another example method for controlling the actuation of fluid ejectors and fluid pumps on a fluid ejection device.

FIG. 8 is a flow diagram illustrating an example method 500 for controlling the actuation of fluid ejectors and fluid pumps on a fluid ejection device. Method 500 provides three different modes of operation for controlling the actuation of fluid ejectors and fluid pumps on a fluid ejection device. Although method 500 is described as being carried out by fluid ejection device 420 of system 410, it should be appreciated that method 500 may also be carried out with other fluid ejection devices and fluid ejection systems, such as the other example fluid ejection devices and systems described in this disclosure.

As indicated by block 510, fluid ejection device 420 receives a mode selection. Such a mode selection may be transmitted from fluid ejection controller 450 in a wired or wireless fashion. In one implementation, selected mode may be made by a person through input device in communication with or as part of system 410. In yet another implementation, fluid ejection controller 450 may determine the most appropriate mode.

As indicated by block 514, in a first mode, electronics 150 selects and actuates a servicing pump at a first frequency, wherein the selection of the fluid pump to service a presently "inactive" fluid ejector is based upon a combination of the address of or which fluid ejector is active (being actuated in response to signals transmitted along line 28) and the offset value O. For example, in one implementation, the offset value O may be a predetermined number of fluid drivers. In response to the first fluid ejector being actuated in response to signals transmitted along line 28, electronics 150 may select a fluid pump associated with an inactive ejector that is spaced from the active fluid ejector by the predetermined number of fluid drivers. For example, in one implementation, when nozzle address 1 of consecutively numbered nozzle addresses is being actuated or is to be actuated using signals transmitted along line 28, and when offset O has a value of three fluid drivers, electronics 150 may automatically select the fluid driver associated with an inactive pump and having an address 4 (address 1 of the fluid driver of the fluid ejector+3 fluid driver addresses) for actuation using signals transmitted along line 30.

As indicated above, in one implementation, the offset value may be stored in nonvolatile memory element 444. In another implementation, the offset value may be stored in a volatile memory element 444. In some implementations, the offset value may be transmitted to electronics 150 by fluid ejection controller 450.

As indicated by block 516, in a second mode of operation, electronics 150 actuates a servicing fluid pump to service an inactive fluid ejector using an address identified in a signal received from fluid ejection controller 450. In such an implementation, electronics 150 does not calculate and determine which pump associated with an inactive fluid ejector is to be actuated for servicing. Instead, electronics 150 automatically transmits actuation signals along line 30 to actuate the pump at the address received from controller 450.

As indicated by block 518, electronics 150 does not actuate an additional or supplemental fluid pump on fluid ejection device 420 using signals transmitted along line 30. As described above with respect to method 300, the mode indicated by block 518 may be automatically selected and implemented in response to the ejection frequency being greater than or equal to a predetermined frequency threshold Ft. In one implementation, fluid ejection controller 450 carries out the comparison indicated in block 306 of method 300 (described above) and transmits the mode selection to electronics 150. In other implementations, electronics 150 determines whether or not to enter the mode indicated by block 518 by carrying out the comparison of the ejection frequency with the frequency threshold. In addition, in some implementations, the actuation of an inactive fluid pump using signals or fire pulses transmitted along line 30 may be temporarily halted when another pump is being actuated or is about to be actuated using signals transmitted along line 28.

Figure 9:
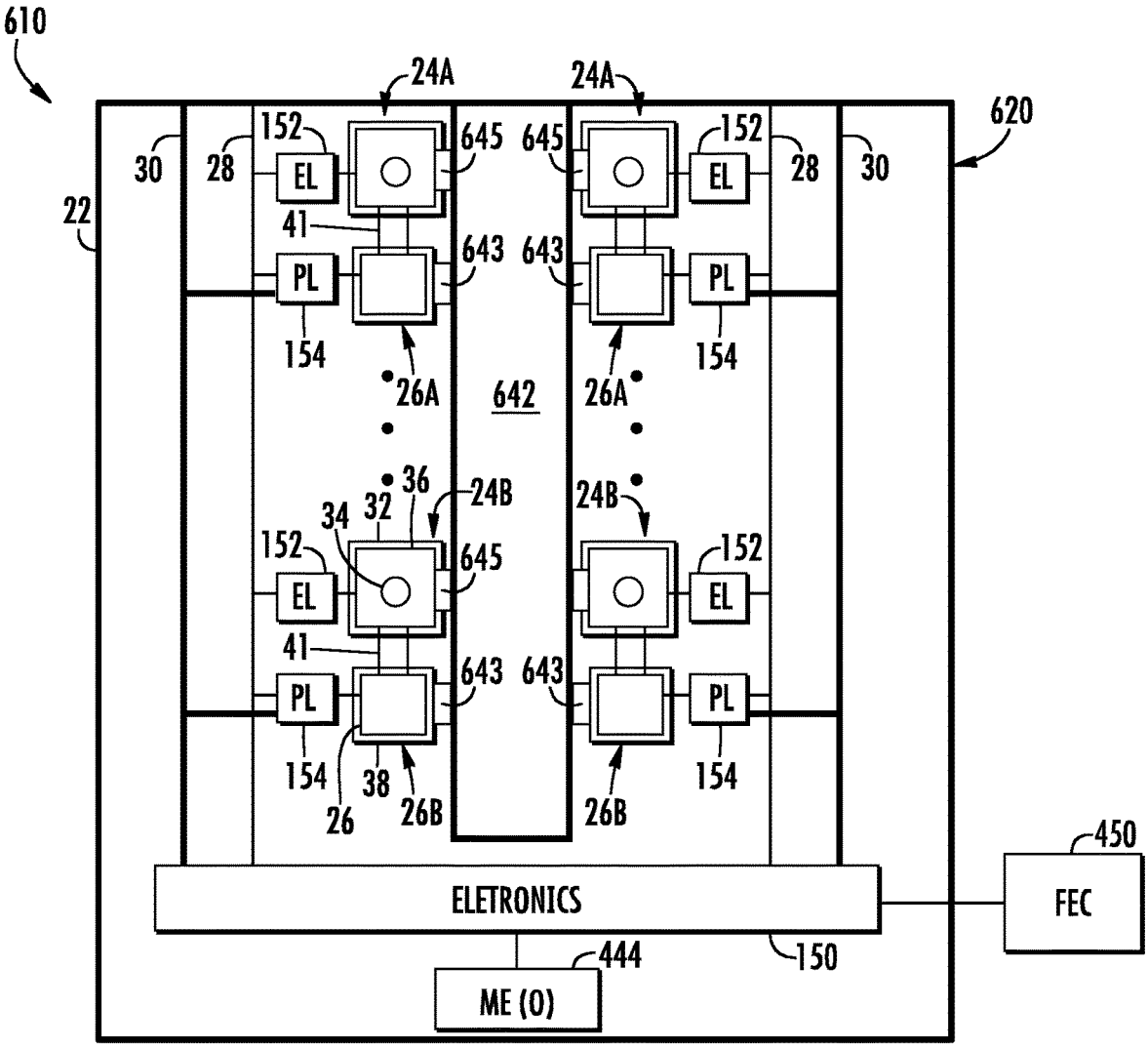
FIG. 9 is a schematic diagram of another example fluid ejection system.
Figure 10:
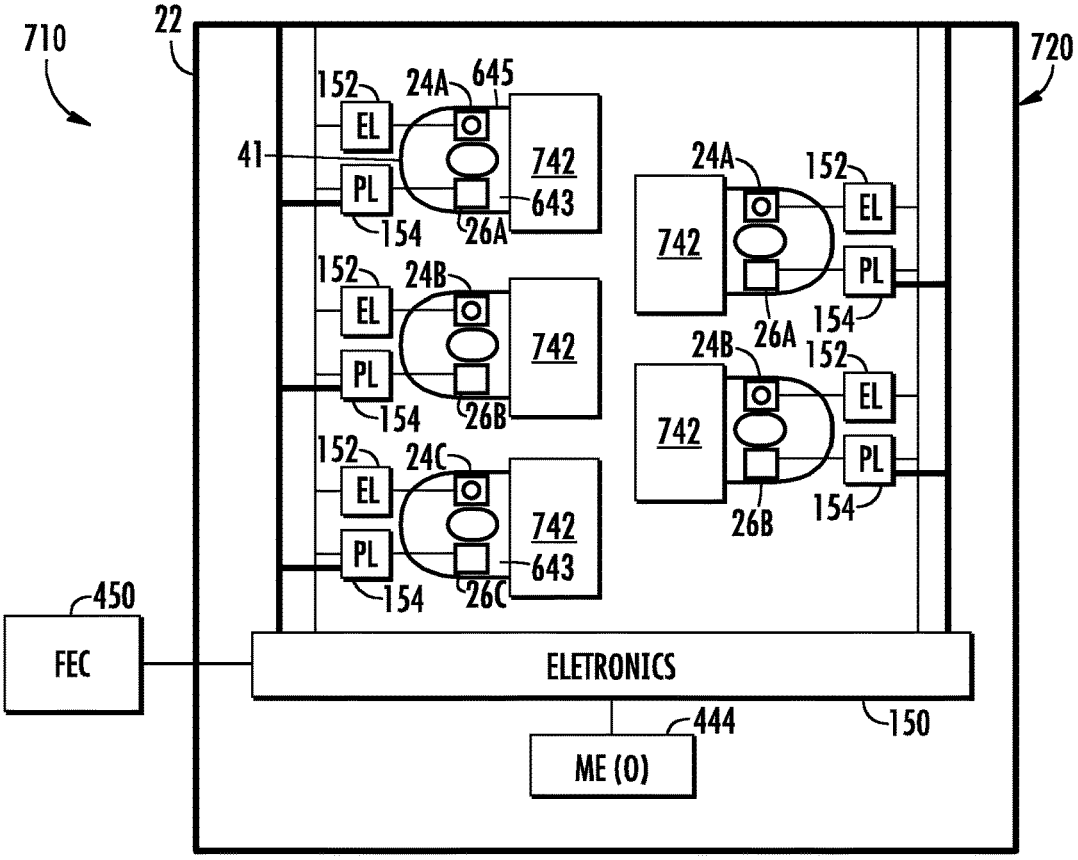
FIG. 10 is a schematic diagram of another example fluid ejection system.
Figure 11:
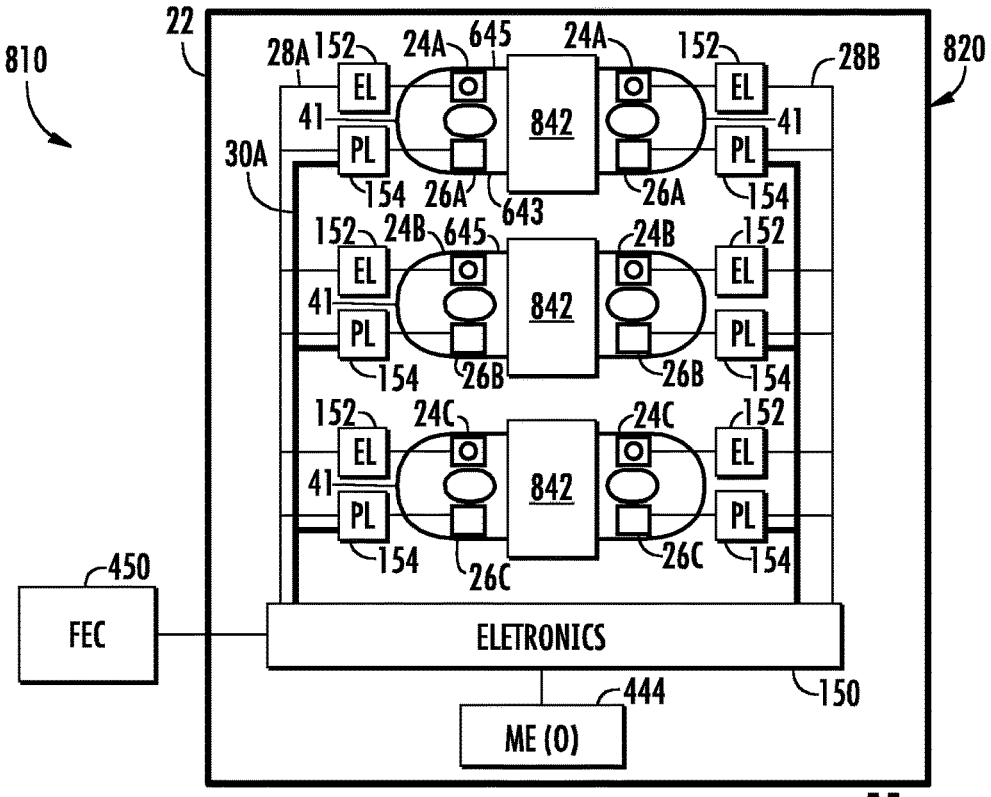
FIG. 11 is a schematic diagram of another example fluid ejection system.

FIGS. 9-11 schematically illustrate three example variations of fluid ejection system 410. FIG. 9 schematically illustrates fluid ejection system 610. Fluid ejection system 610 is similar to fluid ejection system 410 except that fluid ejection system 610 is specifically illustrated as having a recirculation passage in the form of a fluid feed slot 642 that extends along one side of each of the fluid ejector sets 31 of device 420. Device 420 is further illustrated as comprising additional fluid ejector sets 31 on a second opposite side of the slot 642. Each pumping volume 38 of each fluid pump 26 is connected to the slot 642 by an inlet passage 643. Each ejection chamber 32 of each fluid ejector is connected to the slot 642 by an outlet passage 645. Passages 643 and 645 facilitate circulation of fluid from the slot 642, into the pumping volume 38, through passage 41, into the ejection chamber 32 and back into the slot 642 through passage 645. Slot 642 is supplied with fluid from a fluid source (not shown) such as a fluid containing volume of a fluid cartridge to which fluid ejection device 420 is formed or mounted or from a fluid source that is remote with respect to fluid ejection device 420.

FIG. 10 schematically illustrates fluid ejection system 710. Fluid ejection system 710 is similar to fluid ejection system 410 except that fluid ejection system 610 is specifically illustrated as having a recirculation passage in the form of a fluid feed holes 742, wherein each of the holes 742 supply fluid to and receive fluid from an individual fluid ejector set 31 of device 420. Device 420 is further illustrated as comprising an additional second column of fluid ejector sets 31 which are staggered with respect to the first column of fluid ejector sets. Fluid ejector sets 31 and fluid pumps 26 of the first column receive signals via line 28A and line 30A, respectively. In other implementations, such ink feed holes 742 may have other layouts or arrangements other than two-dimensional arrays. In such implementations, a primitive may comprise any grouping of fluid ejector sets 31 (ejector/pump pairs or multiple ejector/shared pump sets). Fluid ejector sets 31 of the second column and fluid pumps 26 receive signals via line 28B and line 30B, respectively.

Each pumping volume 38 of each fluid pump 26 is connected to the feed hole 742 by an inlet passage 743. Each ejection chamber 32 of each fluid ejector is connected to the feed hole 742 by an outlet passage 745. Passages 743 and 745 facilitate circulation of fluid from the feed hole 742, into the pumping volume 38, through passage 41, into the ejection chamber 32 and back into the feed hole 742 through passage 745. Each feed hole 742 is supplied with fluid from a fluid source (not shown) such as a fluid containing volume of a fluid cartridge to which fluid ejection device 420 is formed or mounted or from a fluid source that is remote with respect to fluid ejection device 420.

FIG. 11 schematically illustrates fluid ejection system 810. Fluid ejection system 810 is similar to fluid ejection system 710 except that fluid ejection system 610 is specifically illustrated as having a recirculation passage in the form of a fluid feed holes 842, wherein each of the holes 842 supplies fluid to and receives fluid from a pair of fluid ejector sets 31 of device 420. Each pumping volume 38 of each fluid pump 26 is connected to the feed hole of recirculation passage 842 by an inlet passage 743. Each ejection chamber 32 of each fluid ejector is connected to the hole 842 by an outlet passage 745, passages 743 and 745 facilitate circulation of fluid from the hole 842, into the pumping volume 38, through passage 41, into the ejection chamber 32 and back into the hole 842 through passage 745. Each hole 842 is supplied with fluid from a fluid source (not shown) such as a fluid containing volume of a fluid cartridge to which fluid ejection device 420 is formed or mounted or from a fluid source that is remote with respect to fluid ejection device 420. As with hole 742 of system 710, in other implementations, such ink feed holes 842 may have other layouts or arrangements other than two-dimensional arrays. In such implementations, a primitive may comprise any grouping of fluid ejector sets 31 (ejector/pump pairs or multiple ejector/shared pump sets).

Figure 12:
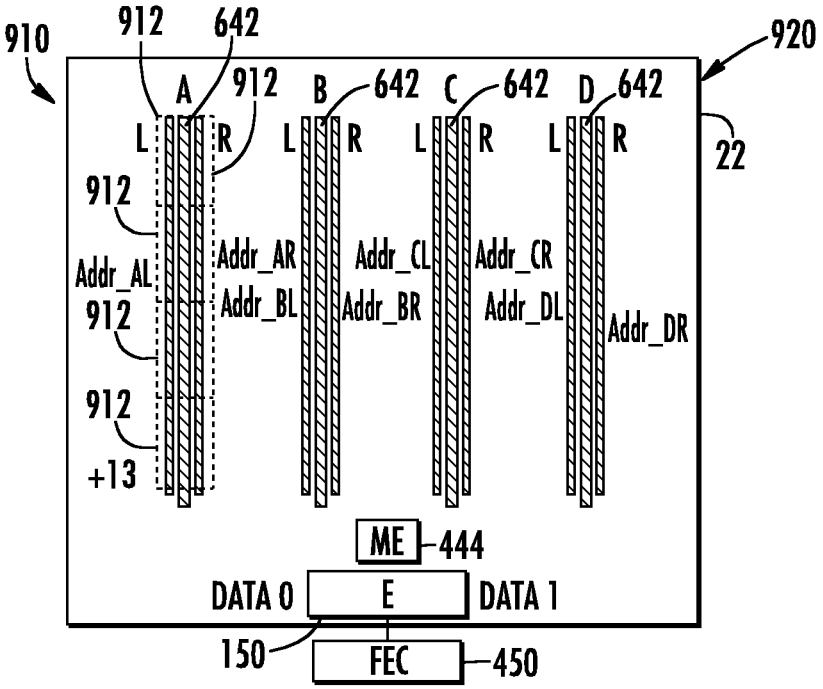
FIG. 12 is a schematic diagram of another example fluid ejection system.

FIG. 12 schematically illustrates fluid ejection system 910, another example implementation of fluid ejection system 410. Fluid ejection system 910 is similar to fluid ejection system 610 described above except that fluid ejection system 610 is illustrated as comprising a fluid ejection device 920 comprising multiple fluid ejection slots 642 (slot A, slot B, slot C and slot D) formed in substrate 22 through which fluid is supplied to columns of fluid ejector sets 31 on each side (the left side L and the right side R) of each of slots 642. As schematically illustrated by broken lines in FIG. 12 with respect to slot A, the fluid drivers forming the alternating fluid ejectors and pumps along the side of slot A are grouped or assigned to distinct primitives 912 on each side of each of slots 642. In one example implementation, the same fluid driver address in each of the primitives connected to the same line 28 is substantially concurrently fired using a single fire pulse transmitted along the line 28.

Figure 13:
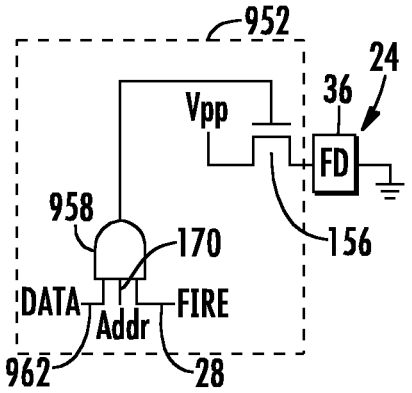
FIG. 13 is a schematic diagram of a fluid driver of a fluid ejector and associated example ejector logic for addressing and firing the fluid driver of the fluid ejector of the system of FIG. 12.
Figure 14:
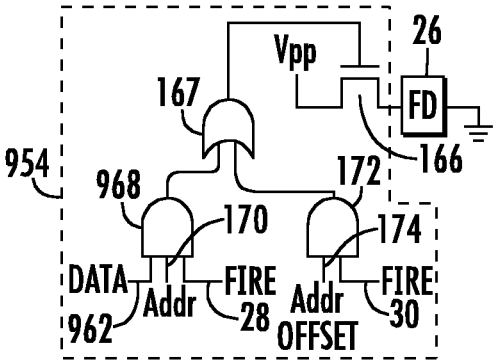
FIG. 14 is a schematic diagram of a fluid driver of a fluid pump and associated example pump logic for addressing and firing the fluid driver of the fluid pump of the system of FIG. 12.

FIGS. 13 and 14 schematically illustrate portions of example individual fluid ejectors and fluid pumps, and their associated logic, of a single grouping of primitives, wherein the fluid drivers of both the ejectors and the pumps are connected to a single line 28 (shown in FIG. 9) and wherein the fluid drivers of the pumps are additionally connected to a single line 30 (shown in FIG. 9). As shown by FIG. 13, the fluid driver 36 of each ejector is selectively actuatable using ejector logic 952. Ejector logic 952 controls the turning on and turning off of the fluid driver 36 forming the ejector 24.

In the example illustrated, ejector logic 952 may comprise a transistor 156 and an AND logic circuitry or gate 958

(schematically illustrated). Transistor 156 is a switch selectively transmitting a voltage Vpp to fluid driver 36 in response to a signal received from AND logic circuitry 158. The AND logic gate 958 transmits the control signals or fire pulse signal received from line 28 to the gate of transistor 156 in response to receiving an address signal from address line 160 and also receiving a data signal from the data line 962. Address line 160 is connected to electronics 150 and receives an address signal from electronics 150 when the particular fluid driver 36 at the selected address is to be enabled for possibly firing. In the example illustrated, each fluid driver address of each of primitives 912 forming a grouping on a side of slots 642 is connected to electronics 150 by a single transmission line 170. For example, a single transmission line 170 may extend from electronics 150 into connection with the same fluid driver address in each of the primitives 912 of a group of primitives (all the primitives having fluid drivers connected to the same line 28).

Data line 962 is connected to electronics 150 and receives a data signal from electronics 150 when the particular primitive 912 is to be enabled firing. In the example illustrated, each of primitives 912 is connected to electronics 150 by an assigned data line 962. Enabling signals must be received from both address line 170 and data line 962 for logic 952 to fire the fluid driver 36 of the ejector in accordance with the fire pulse received on line 28.

As shown by FIG. 14, the fluid driver each pump 26 is selectively actuatable using pump logic 954. Pump logic 954 controls the turning on and turning off of the fluid driver forming pump 26. As shown by FIG. 14, in one implementation, pump logic 954 may comprise a transistor 166, OR logic circuitry or gate 167, AND logic circuitry or gate 968 and AND logic circuitry or gate 172. Transistor 166 is a switch selectively transmitting a voltage Vpp to fluid driver of pump 26 in response to a signal received from OR logic gate 167. The OR logic gate 167 transmits a fire pulse signal (received from either gate 168 or gate 172) to the gate of transistor 166, turning on transistor 166 and firing the fluid driver of pump 26. The AND logic gate 968 transmits the fire pulse signal being received from line 28 to the OR logic gate 167 in response to receiving an address signal from address line 170 and also receiving an enabling data signal from line 972. Address line 170 is connected to electronics 150 and receives the address signal from electronics 150 when the fluid driver of the particular pump 26 at the selected address is to be fired using a fire pulse transmittal along line 28.

Data line 962 is connected to electronics 150 and receives a data signal from electronics 150 when the particular primitive 912 is to be enabled firing. In the example illustrated, each of primitives 912 is connected to electronics 150 by an assigned data line 972. Enabling signals must be received from both address line 170 and data line 962 for logic 954 to fire the fluid driver of the fluid pump 26 in accordance with the fire pulse received on line 28.

The AND logic gate 172 transmits the fire pulse signal being transmitted along line 30 to the OR logic gate 167 in response to receiving an address signal from address line 174. Address line 174 is connected to electronics 150 and receives an address signal from electronics 150 when the fluid driver of the particular pump 26 at the selected address in each of the primitives 912 is to be fired using a fire pulse being transmitted along line 30.

As with system 610, electronics 150 of system 910 carry out methods 200, 300 and 500 described above. With respect to method 200, electronics 150 eject fluid at a first frequency by actuating fluid ejectors at the first frequency (block 210). In the example illustrated in FIG. 10, electronics 150 outputs control signals which are transmitted along fire pulse line 28 (shown in FIG. 7) on each side of each of slots 642. Through the use of ejector logic 952 (described above), a fluid ejector is actuated or fired in each of the primitives 912 of a particular primitive grouping along a side of a corresponding slot 642. For example, each primitive may have multiple fluid ejector sets A-N, wherein each set comprises a fluid ejector and associated fluid pump. Electronics 150 may output control signals causing each fluid ejector set C in each of primitives 912 to be actuated, wherein the fluid ejector and the fluid pump of set C is actuated. This may occur for each and every column of fluid ejector sets on each side of each of slots 642.

With respect to method 200, electronics 150 may additionally service those inactive fluid ejectors at a second frequency greater than the first frequency at which the fluid sets 31 of each primitive 912 are being actuated by actuating fluid pumps associated with the inactive fluid ejectors at the second frequency (block 220). In the example illustrated in FIG. 10, electronics 150 outputs control signals which are transmitted along fire pulse line 30 (shown in FIG. 7) on each side of each of slots 642. Through the use of pump logic 954 (described above), a selected fluid pump associated with an inactive fluid ejector is actuated or fired in each of the primitives 912. Electronics 150 may output control signals along line 28 that actuate, using signals transmitted along line 30, the same particular fluid pump in each of the primitives 912 along a side of the corresponding slot 642. For example, each primitive may have multiple fluid ejector sets A-N, wherein each set comprises a fluid ejector and associated fluid pump. Electronics 150 may further output control signals causing each fluid pump F in each of primitives 912 to be actuated, wherein pump F in each primitive is spaced from the active fluid ejector of set C in the same primitive by the offset O. This may occur for each and every column of fluid ejector sets on each side of each of slots 642.

With respect to method 300, electronics 150 may operate in either of the modes indicated by blocks 320 and 330 in FIG. 4 based upon whether the ejection frequency of the fluid ejectors in each of the primitives in a column of fluid ejector sets on a side of a slot 642 is less than the predetermined frequency threshold (block 306 in FIG. 4). With respect to method 500, electronics 150 may operate in any of the three modes indicated by blocks 514, 516 and 518 as described above respect to FIG. 8. In some implementations, electronics 150 may operate pursuant to a different one of the modes indicated in blocks 514, 516 and 518 for different columns of fluid ejector sets along different slots 642 which may be delivering and ejecting different fluids. For example, in some implementations, slot A and slot B may be delivering different fluids having different characteristics, wherein the different fluids result in the use of different frequency thresholds Ft for those fluid ejector sets 31 along the different slots A and B. As a result, in certain circumstances, electronics 150 may be servicing inactive fluid ejectors pursuant to block 220 or block 320 in FIGS. 3 and 4 for those fluid ejectors along slot A while the same time not servicing inactive fluid ejectors pursuant to block 330 in FIG. 4 for those fluid ejectors along slot B.

FIG. 15 illustrates pair of example data packets 1000, 1002 to be transmitted from fluid ejection controller 450 to electronics 150 for the control of the fluid ejectors and pumps on fluid ejection device 920 of system 910. Each of data packets 1000, 1002 has a header portion 1004 and a data portion 1006. FIG. 15 illustrates the first 14 clock cycles for the transmission of fire pulse group data for slots A and B on the left and slots C and D on the right. As should be understood, there may be more cycles in a data packet depending upon the number of primitives. Each clock cycle has a rise time and a fall time, during each of which signals on a separate signal transmission line are read. For example, during clock cycle 1, the voltage on a separate signal transmission line is sensed once during the rise of the clock cycle and once during the fall of the clock cycle. The different sensed voltages may correspond to either a zero or a one (binary) and represent information being transmitted. The information contained in the each data packet is stored by electronics 450 and is used to enable selected fluid driver addresses to receive fire pulses transmitted along either line 28 or line 30. The selection of the fluid driver address is achieved using signals transmitted along data lines 962 (enabling selected primitives) and signals transmitted along address lines 170, 174 (enabling selected address in each primitive) in combination with the ejector and pump logic 952 and 954 described above.

In the example illustrated, binary signals (0 or 1) transmitted during clock cycles 1 and 2 indicate the selected mode: Mode 0, Mode 1, or Mode 2. In Mode 0, electronics 150 operates pursuant to block 330 in FIG. 4, wherein servicing fluid pumps associate with inactive fluid ejectors are not additionally actuated. Mode 0 may occur when the fluid ejection frequency is greater than the frequency threshold Ft. Mode 0 may also automatically occur when a fluid pump 26 is to be fired based upon a fire pulse transmitted along line 28. Mode 1 corresponds to the mode described above with respect to block 514 of method 500 in FIG. 6, wherein the servicing fluid pump to be actuated to service an inactive fluid ejector is selected based upon the current active fluid ejector and a stored predetermined offset O.

FIG. 15 illustrates such data packet 1000 and 1002 during Mode 1. Information received during the clock cycles of the data packet 1000 and 1002 is stored and utilized by a fire pulse generator of electronics 150 to generate a fire pulse generation signal which concurrently fires the addressed fluid ejector of each of the selected primitives. In the example illustrated, the binary signals transmitted (the sensed voltages) on the separate transmission line during clock signals 5-8, particularly during the rise of each of the clock signals 5-8, indicates the address of the fluid driver in each of the primitive 912 on the left side L of slots A and B for which the data packet applies during a single fire pulse. In other words, the signals transmitted during clock cycles 5-8 instruct electronics 150 as to which address lines 170 are to transmit an enablement signal from electronics 150. The data header shown in FIG. 15 may be directed to or applicable to those fluid drivers of fluid ejectors in the various primitives 912 having a first particular address. For example, each primitive 912 may have a fluid ejector having an address X, wherein an indication of address X during clock cycles 5-8 instructs electronics 150 that the data received during clock cycles 9-14 indicates whether the particular fluid ejector in each of the primitives having address X is to be fired or not fired. The data headers of multiple data packets may cycle through each of the fluid drivers of both the fluid ejectors and the fluid pumps (in an alternating fashion) in each of the primitives 912 (each of the different addresses of the fluid ejectors in a primitive), providing instructions for the generation of a fire pulse for each of the fluid drivers in each of the primitives 912.

As indicated in FIG. 15, in clock cycles 9-14 and on, the data header indicates, for each primitive 912, whether the address identified in cycles 5-8 is to be fired. In other words, the signals transmitted during cycles 9-14 and on instruct electronics 150 as to which data lines 962 are to transmit an enablement signal from electronics 150. For example, the signal (a sensed voltage corresponding to either a zero or a one) received during the rise of clock cycle 9 indicates whether the fluid ejector of primitive A2 having the address indicated in clock cycles 5-8 should be fired (a value of one received during the rise of clock cycle 9) or should not be fired (a value of zero received during the rise of claim cycle 9). Likewise, the signal received during the fall of clock cycle 9 indicates whether the fluid ejector of primitive A1 (of slot A) having the address indicated in clock cycles 5-8 should be fired (a value of one received during the fall of clock cycle 9) or should not be fired (a value of zero received during the fall of claim cycle 9). The signal received during the rise of clock cycle 10 indicates whether the fluid ejector of primitive B2 (of slot B) having the address indicated in clock cycles 5-8 should be fired (a value of one received during the rise of clock cycle 10) or should not be fired (a value of zero received during the rise of claim cycle 10) and so on.

In the example illustrated, each primitive 912 has 16 fluid driver addresses (eight addresses for fluid drivers of fluid ejectors and eight addresses for the fluid drivers of fluid pumps), wherein the fluid drivers of ejectors or active ejectors AE have even addresses and the fluid drivers of fluid pumps have odd addresses in a 1:1 ratio. In the example illustrated, the on die or stored offset value O is 13. In the example illustrated, the fluid drivers of the fluid ejectors of each of the primitives 912 are actuated in the following order of addresses: 0, 6, 12, 2, 8, 14, 4, and 10. Prior to the firing of the fluid drivers of each fluid ejector, the fluid driver of the fluid pump associated with the fluid ejector about to be fired is fired to provide fresh fluid to the ejection chamber of the fluid ejector about to be fired. During this time, system 910 automatically enters mode 0 such that two pumps are not fired at the same time. Once the fluid driver of the pump associated with the fluid ejector about to be fired has been fired, system 910 may return to Mode 1. With the offset of 13, the servicing pumps are then fired based upon the presently active ejector AE +13, resulting in the order of servicing pump addresses: 13, 3, 9, 15, 5, 11, 1 and 7. As described above, the servicing pump addresses are fired or actuated at a frequency greater than the frequency at which the fluid ejectors are fired or actuated.

FIG. 16 illustrates another example pair of data packets 1100 and 1102 to be transmitted from fluid ejection controller 450 to electronics 150 for the control of the fluid ejectors and pumps on fluid ejection device 920 of system 910. The data packets 1100 and 1102 shown in FIG. 16 are similar to the data packets 1000 and 1002 shown in FIG. 15 except that FIG. 16 illustrates the data packets when operating pursuant to Mode 2 in which the address of the servicing pump is embedded in the data header received by electronics 150 from fluid ejection controller 450. As shown by FIG. 16, signals received (sensed voltages) on the separate transmission line during the fall of clock cycles 5-8 indicates the address of the servicing pump (the pump associated with an inactive fluid ejector) of each primitive 912 that is to be fired in accordance with a separate generated fire pulse signal transmitted along each line 30 which occurs at a frequency greater than the frequency at which the fluid ejectors (and their associated fluid pumps) are being fired in response to fire pulse signals transmitted along each line 28.

In the example illustrated, data header 1100 provides control instructions for an implementation of fluid ejection device 920 in which fluid ejectors and pumps are provided on substrate 22 in a ratio of 2:1, wherein a single fluid pump services two adjacent fluid ejectors, each pump being fluidly connected to the ejection chambers of each of the two adjacent fluid ejectors. In the example illustrated, fluid ejection controller 450 consults the example look up table 1130 to determine, based upon the address of the active ejector AE indicated to electronics 150 during the rise of clock cycles 5-8, the address of the servicing pump which is communicated to electronics 150 during the fall of clock cycles 5-8. In the example illustrated, if the active ejector indicated to electronics 150 during the rise of clock cycles 5-8 has an address of 0 or 3, look up table 1130 indicates that the address of the servicing pump (associated with a presently inactive fluid ejector) is 10. This address is then embedded in the signal communicated to electronics 150 during the fall of clock cycles 5-8. Likewise, if the active ejector indicated to electronics 150 during the rise of clock cycles 5-8 has an address of 6 or 1, look up table 1130 indicates that the address of the servicing pump (associated with a presently inactive fluid ejector) is 9, and so on. With the example 2:1 ratio of fluid ejectors to pumps in each fluid ejector set 31, ejection controller 450 fires the fluid ejectors with a skip 2 pattern of addresses: 0, 3, 6, 1, 4, 7, 2 and 5. As should be appreciated, the transmission of information to electronics 150 indicating which fluid ejector is to be fired and which fluid pump associated with an inactive fluid ejector is to be fired may be carried out in various other fashions to provide high-frequency servicing of fluid ejectors on fluid ejection device 920 during low frequency fluid ejection.

Although FIGS. 12-16 have been described with respect to fluid ejection system 910 having groups of primitives 912, with each group extending along a single side of a fluid feed slot 642, it should be appreciated that the example ejector logic 952, example pump logic 954, example data packets 1000, 1002, 1100, 1102 as well as the above described methods may likewise be carried out respect to groups of primitives having other primitive groupings or receiving fluid other than through a slot. For example, in lieu of fluid ejection device 920, system 910 may comprise fluid ejection device 720 and or fluid ejection device 820, wherein the fluid drivers of the fluid ejectors and fluid pumps are apportioned into different groupings of primitives, each group of primitives receiving fire pulses through a single associated line 28. It should further be appreciated that the primitive groupings may have non-linear layouts or arrangements, other than the columns of fluid drivers illustrated in FIG. 12.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An apparatus comprising:

a fluid ejection device comprising:

fluid ejectors;

fluid pumps to circulate fluid to the fluid ejectors;

a first actuation signal line connected to each of the fluid ejectors and each of the fluid pumps along which a first signal is transmittable to actuate a selected one of the fluid ejectors and the fluid pumps; and at least one second actuation signal line connected to the fluid pumps along which a second signal is transmittable to actuate a selected one of the fluid pumps.

2. The apparatus of claim 1, wherein the fluid ejection device further comprises electronics to:

transmit actuation signals along the first actuation signal line at a first frequency to eject fluid at the first frequency by actuating selected ones of the fluid ejectors and their associated pumps at the first frequency; and transmit actuation signals along the at least one second actuation signal line to actuate, at a second frequency, greater than the first frequency, those fluid pumps associated with presently inactive fluid ejectors.

3. The apparatus of claim 2, wherein the electronics are to select a fluid pump for actuation at the second frequency based upon which of the fluid ejectors is being actuated at the first frequency.

4. The apparatus of claim 3, wherein the electronics store an offset value, wherein selection of the fluid pump for actuation at the second frequency is based upon a combination of which of the fluid ejectors is being actuated at the first frequency and the stored offset.

5. The apparatus of claim 4 further comprising a fluid ejection controller, wherein the fluid ejection controller is to transmit the offset to the electronics which store the offset.

6. The apparatus of claim 2, wherein the electronics are selectively operable in different modes comprising:

a first mode in which the electronics are to select one of the fluid pumps for actuation at the first frequency based upon a combination of which of the fluid ejectors is being actuated at the second frequency and an offset; and a second mode in which the electronics are to actuate one of the fluid pumps, as identified in a received signal, for actuation at the first frequency.

7. The apparatus of claim 6, wherein said one of the fluid pumps identified in the received signal in the second mode is identified by bits in a data header signal.

8. The apparatus of claim 7 further comprising a fluid ejection controller, wherein the fluid ejection controller is to transmit an identification of said one of the fluid pumps for actuation at the first frequency in the second mode.

9. The apparatus of claim 8, wherein each of the fluid pumps supplies fluid to a plurality of the fluid ejectors, wherein the electronics are to identify said one of the fluid pumps for actuation at the first frequency in the second mode based upon which of the fluid ejectors is to be actuated at the second frequency.

10. The apparatus of claim 6, wherein the different modes further comprise a third mode in which the electronics do not actuate the fluid pumps through the transmission of actuation signals along the at least one second actuation signal line.

11. The apparatus of claim 2, wherein the electronics are to actuate one of the fluid pumps, as identified in a received signal, for actuation at the first frequency.

12. The apparatus of claim 2, wherein the electronics are operable in different modes, the different modes comprising:

a first mode in which the electronics transmit actuation signals along the at least one second actuation signal line at a first frequency to actuate a selected one of the fluid pumps while the fluid ejectors and the fluid pumps are being actuated in response to actuation signals along the first actuation signal line at a second frequency less than the first a second mode in which the electronics do not actuate the fluid pumps through the transmission of actuation signals along the at least one second actuation signal line, wherein the electronics operate in one of the first mode and the second mode based upon a comparison of the second frequency with a predetermined threshold frequency.

13. A method comprising:

ejecting fluid at a first frequency by actuating fluid ejectors and their associated pumps at the first frequency; and servicing inactive fluid ejectors at a second frequency greater than the first frequency by actuating fluid pumps associated with inactive fluid ejectors at the second frequency.

14. The method of claim 13 further comprising selecting which of the fluid pumps to actuate at the second frequency based upon which of the fluid ejectors and the fluid pumps are being actuated at the first frequency.

15. A fluid ejection system comprising:

a print controller to transmit signals to a fluid ejection device, the signals directing the fluid ejection device to:

eject fluid at a first frequency by actuating fluid ejectors and their associated pumps at the first frequency; and service inactive fluid ejectors at a second frequency greater than the first frequency by actuating fluid pumps associated with inactive fluid ejectors at the second frequency.

* * * * *